US007926974B2

(12) United States Patent
Wung et al.

(10) Patent No.: US 7,926,974 B2
(45) Date of Patent: Apr. 19, 2011

(54) LIGHT-GUIDING MODULE AND LED LAMP USING THE SAME

(75) Inventors: Shih-Hsun Wung, Taipei Hsien (TW); Yong-Dong Chen, Shenzhen (CN); Xiao-Yu Hu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 296 days.

(21) Appl. No.: 12/331,394

(22) Filed: Dec. 9, 2008

(65) Prior Publication Data

US 2010/0053953 A1 Mar. 4, 2010

(30) Foreign Application Priority Data

Aug. 26, 2008 (CN) ..... 2008 1 0304203

(51) Int. Cl.
*F21V 1/06* (2006.01)

(52) U.S. Cl. ..... 362/237; 362/235; 362/225

(58) Field of Classification Search ..... 362/225, 362/235, 237, 249.02, 555
See application file for complete search history.

(56) References Cited

U.S. PATENT DOCUMENTS 7,654,691 B2 * 2/2010 Liu et al. ..... 362/249.02
2009/0257224 A1 * 10/2009 Huang et al. ..... 362/249.02
* cited by examiner

*Primary Examiner* — David V Bruce
(74) *Attorney, Agent, or Firm* — Frank R. Niranjan

(57) ABSTRACT

An LED lamp includes a heat sink, a plurality of LED modules mounted on a top of the heat sink and a plurality of light-guiding modules respectively fixed on the LED modules. The heat sink includes a base and a plurality of fins extending downwardly from the base. Each LED module includes a plurality of LEDs mounted thereon. Each light-guiding module includes a mounting bracket defining a plurality of through holes therein and a plurality of guiding units respectively received in the through holes of the mounting bracket. The guiding units are respectively in alignment with the LEDs of a corresponding LED module and receive the LEDs in lower ends thereof to reflect and guide light generated by the corresponding LED module in a predetermined manner.

18 Claims, 4 Drawing Sheets

LIGHT-GUIDING MODULE AND LED LAMP USING THE SAME

BACKGROUND OF THE INVENTION

1. Field of the Invention

The disclosure relates to a light-emitting diode (LED) lamp and, more particularly, to an LED lamp using a light-guiding module applicable with various types of LED modules.

2. Description of Related Art

An LED lamp is a type of solid-state lighting that utilizes light-emitting diodes (LEDs) as a source of illumination. LEDs convert electricity to light via current through a junction region comprising two different semiconductors, by which electrons and holes coupled at the junction region generate the light. LED's advantages of resistance to impact and nearly limitless lifetime under certain conditions make an LED lamp a cost-effective yet high quality replacement for incandescent and fluorescent lamps.

Known implementations of LED modules in an LED lamp use a plurality of individual LEDs to generate light reflected by a light-guiding module to obtain sufficient illumination of suitably wide distribution. A conventional light-guiding module is integrally fabricated and suited only for use in the type of LED lamp for which its use is intended, such that in order to equip a variety of LED lamps, development and manufacture of a wide range of light-guiding module types are required, representing considerable cost and material burdens.

What is needed, therefore, is a light-guiding module suitable for application with a variety of LED lamp types, thereby overcoming the described limitations.

SUMMARY OF THE INVENTION

An LED lamp includes a heat sink, a plurality of LED modules mounted on a top of the heat sink and a plurality of light-guiding modules respectively fixed on the LED modules. The heat sink includes a base and a plurality of fins extending downwardly from the base. Each LED module includes a plurality of LEDs mounted thereon. Each light-guiding module includes a mounting bracket defining a plurality of through holes therein and a plurality of guiding units respectively received in the through holes of the mounting bracket. The guiding units are respectively in alignment with the LEDs of a corresponding LED module and receive the LEDs in lower ends thereof to reflect and guide light generated by the corresponding LED module in a predetermined manner.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
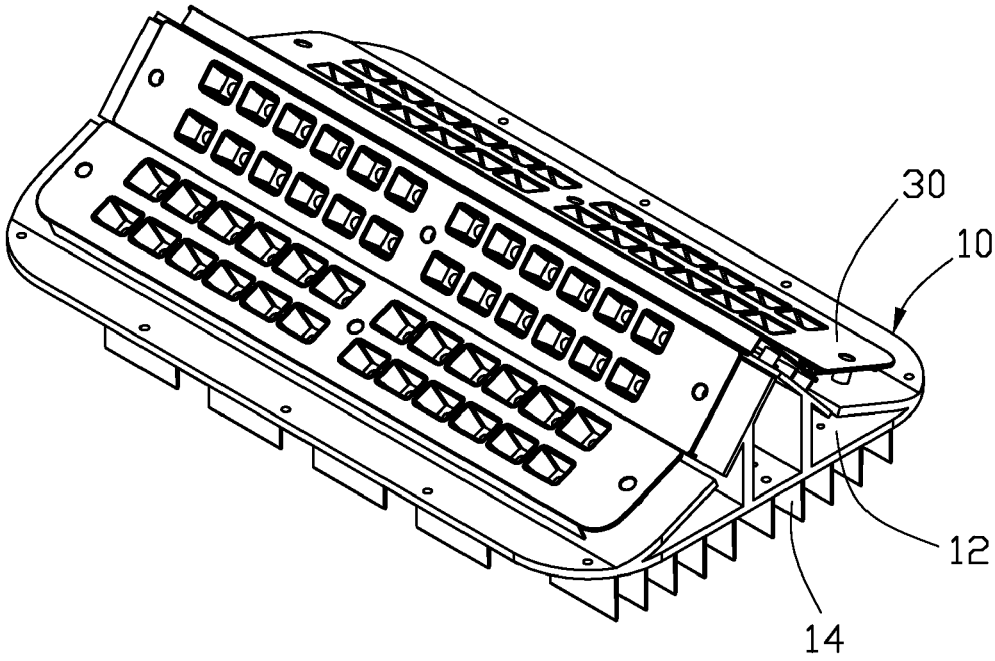
FIG. 1 is an isometric, assembled view of an LED lamp in accordance with a preferred embodiment of the disclosure.
Figure 2:
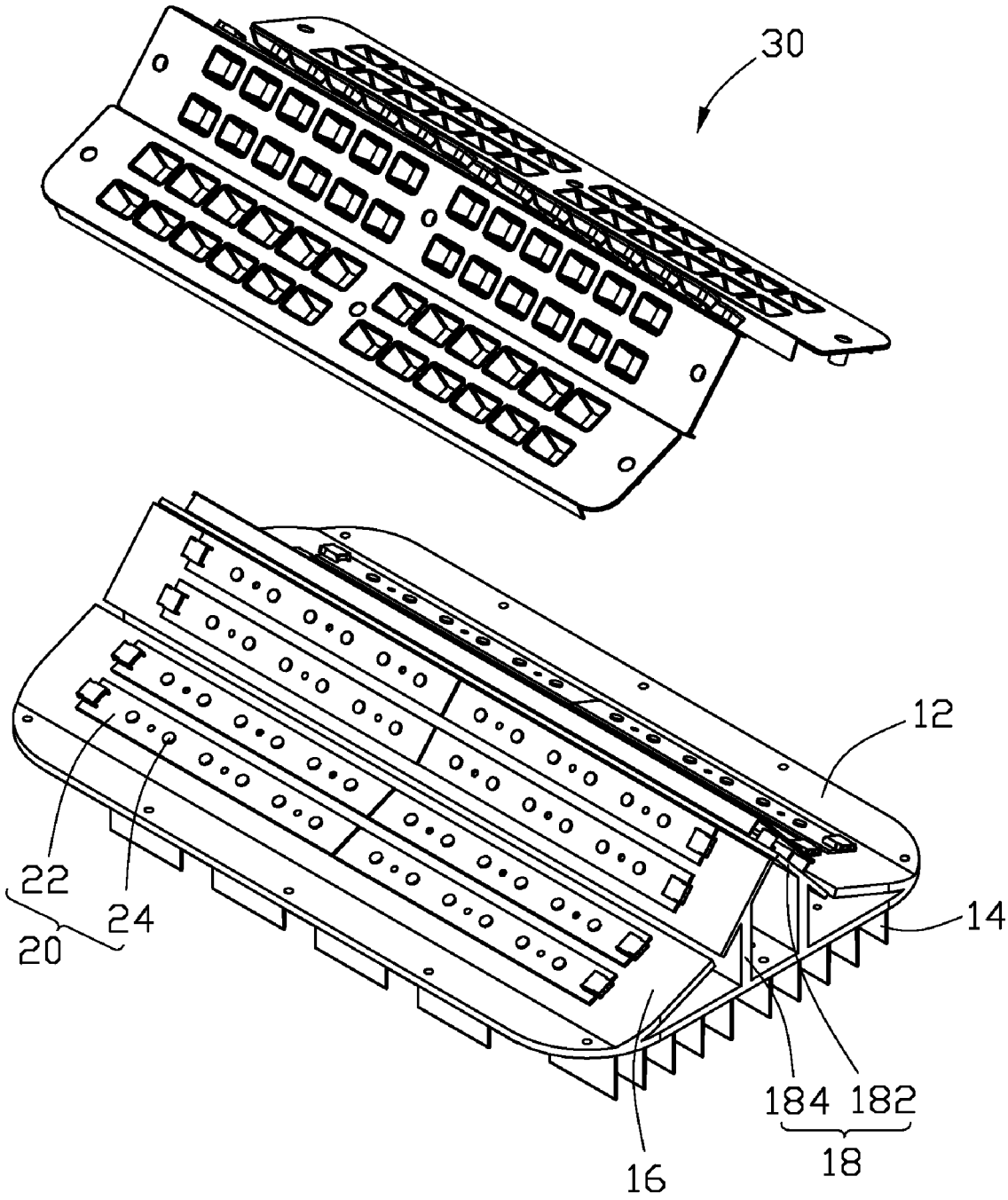
FIG. 2 is an exploded view of the LED lamp of FIG. 1.
Figure 3:
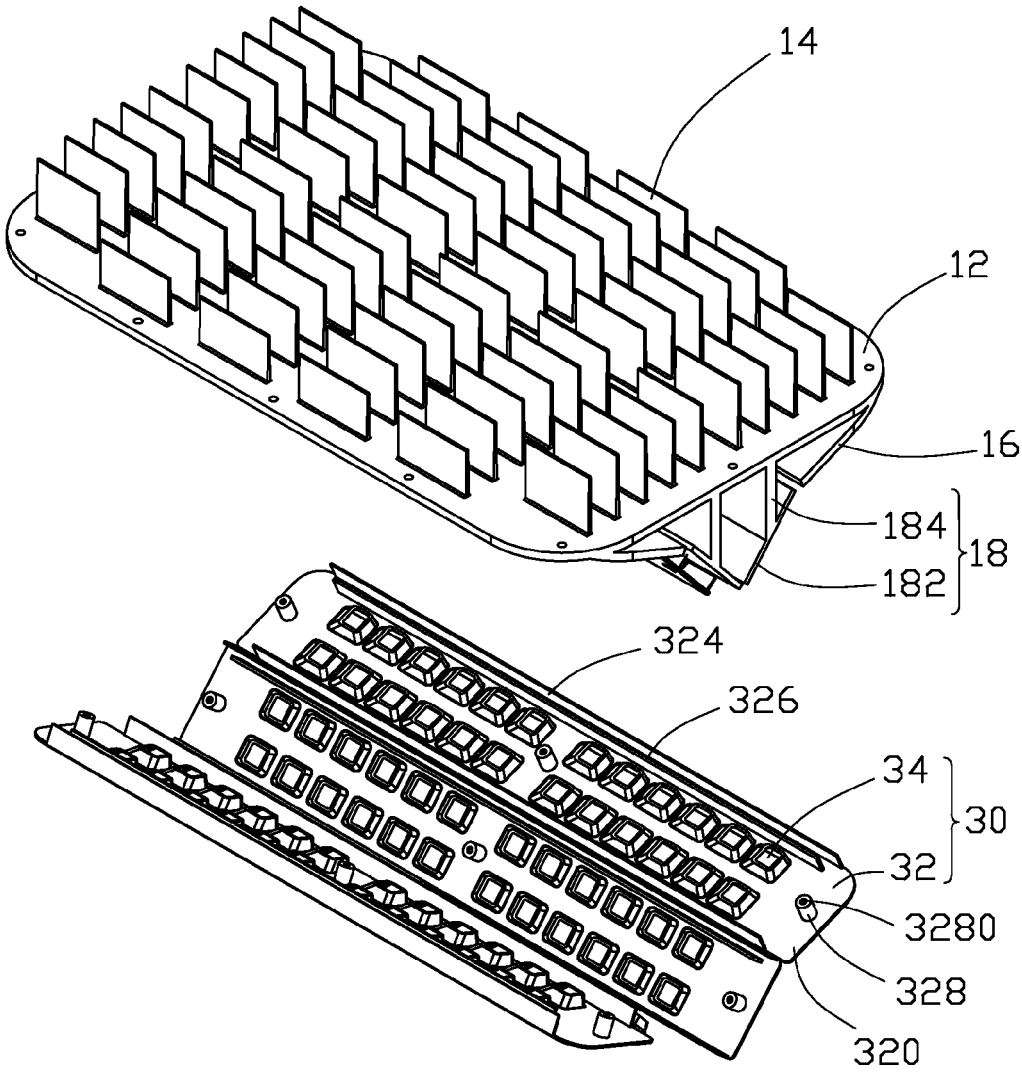
FIG. 3 is an inverted view of the LED lamp of FIG. 2.

Referring to FIGS. 1-3, an LED lamp in accordance with a preferred embodiment is illustrated. The LED lamp comprises a heat sink 10, a plurality of LED modules 20 fixed to a top of the heat sink 10, and a plurality of light-guiding modules 30 respectively mounted over the LED modules 20.

The heat sink 10 is integrally made of a metal with good heat conductivity such as copper or aluminum, and comprises a substantially rectangular base 12, a plurality of fins 14 extending downwardly from a bottom surface of the base 12 and a plurality of mounting members arranged on a top surface of the base 12. The fins 14 are spaced from each other, perpendicular to the bottom surface of the base 12 and parallel to two opposite lateral sides and the midline of the base 12.

The mounting members include two first mounting members 18 located at a midline of the top surface of the base 12 and two second mounting members located at two lateral sides of the first mounting members 18. Each first mounting member 18 comprises a first mounting plate 182 separated from the top surface of the base 12 and a first connecting plate 184 extending upwardly from the top surface of the base 12 and connected to a middle portion of a bottom surface of a corresponding first mounting plate 182. The two first connecting plates 184 are spaced from each other, perpendicular to the top surface of the base 12 and parallel to the fins 14. The two first mounting plates 182 are angled toward each other from the top surface of the base 12 and positioned symmetrically relative to an imaginary plane passing through a midline of the base 12 and perpendicular to the base 12. The second mounting members are positioned symmetrically relative to the imaginary plane. The second mounting members each comprise a second mounting plate 16 extending obliquely and inwardly from the top surface of the base 12. The two second mounting plates 16 on which the LED modules 20 are respectively mounted are angled to the top surface of the base 12. Angles between the first and second mounting plates 182, 16 and the top surface of the base 12 gradually decrease from the midline of the top surface of the base 12 toward the two opposite lateral sides of the base 12. Thus, the LED lamp has a wider illumination angle than other LED lamps.

Particularly referring to FIG. 2, each LED module 20 comprises an elongated printed circuit board 22 and a plurality of spaced LEDs 24 evenly mounted on a side of the printed circuit board 22. The LEDs 24 of each LED module 20 are arranged along a longitudinal axis of the printed circuit board 22. Every two of the LED modules 20 are mounted side by side on a corresponding first or second mounting plate 182/16 of the mounting member of the heat sink 10 by screws (not shown).

Each light-guiding module 30 is fixed on one of the first, second mounting plates 182/16 to cover the two neighboring LED modules 20 and guide the light generated by the LEDs 24 in a predetermined manner. Each light-guiding module 30 comprises a mounting bracket 32 and a plurality of guiding units 34 mounted in the mounting bracket 32. The guiding units 34 are separably formed from the mounting bracket 32.

Each mounting bracket 32 comprises a rectangular fixing board 320, two restricting flanges 324 extending downwardly from two opposite edges of the fixing board 320 and two supporting flanges 326 extending downwardly from a bottom surface of the fixing board 320. The fixing board 320 defines a plurality rectangular through holes 322 therein for receiving the guiding units 34 therein. The through holes 322 are arranged in two lines along a longitude axis of the fixing board 320 corresponding to the LEDs 24 of the two neighboring LED modules 20 mounted on the same first or second mounting plates 182/16. The restricting flanges 324 parallel to the supporting flanges 326 and perpendicular to the fixing board 320, have a height larger than that of the supporting flanges 326, whereby the restricting flanges 324 of the mounting bracket 32 are rested on the top surface of the mounting plate 182/16 closely besides two respective outer edges of the two neighboring LED modules 20 mounted on the mounting plate 182/16, whilst the two supporting flanges 326 located closely to inner sides of the corresponding restrict flanges 324 are rested on the respective printed circuit boards 22 of the two neighboring LED modules 20. Each mounting bracket 32 has two fixing posts 328 extending downwardly from the bottom surface thereof and located respectively adjacent to two opposite ends thereof. The retaining posts 328 are rested on the top surface of the mounting plate 182/16 and each therein define an extending hole through which screws (not shown) extend to engage into the mounting plate 182/16 to secure the mounting bracket 32 on the mounting plate 182/16.

Figure 4:
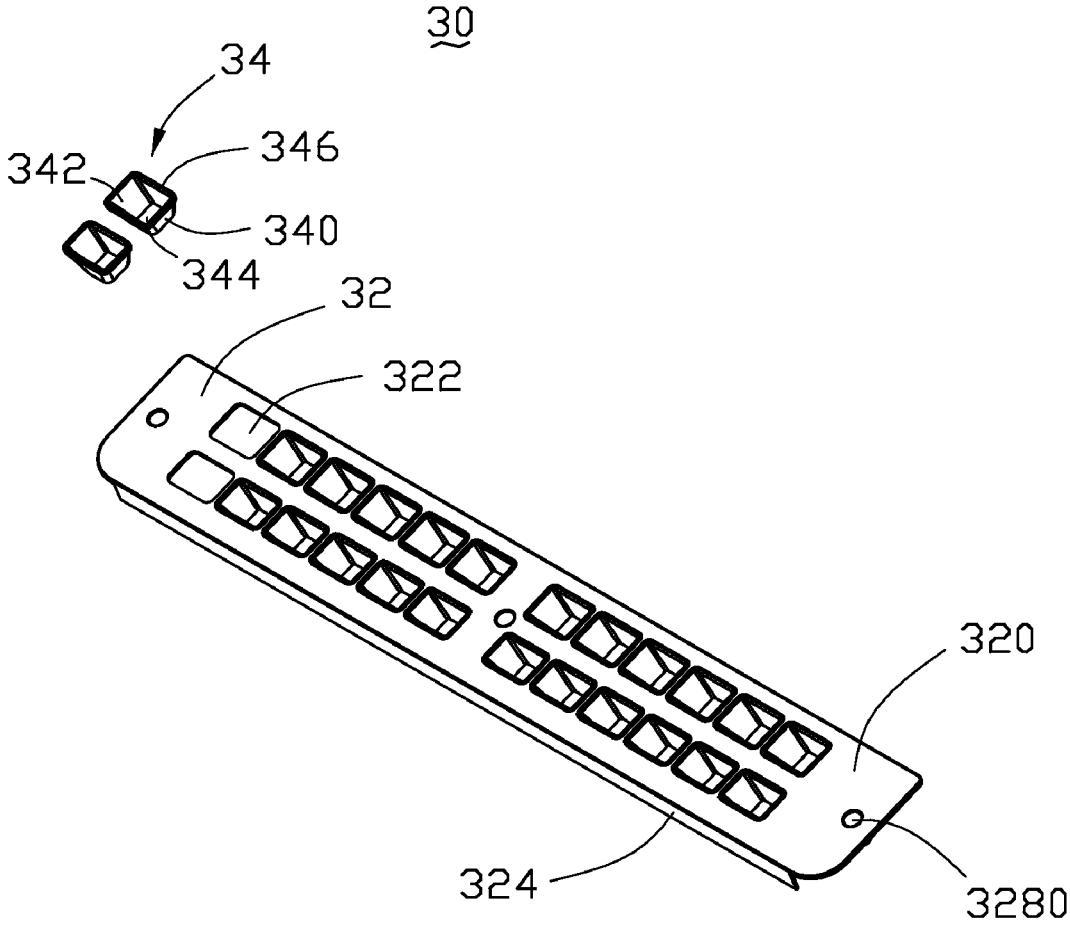
FIG. 4 is an enlarged, exploded view of a light-guiding module of FIG. 2.

Referring to FIG. 4, each guiding unit 34 comprises four inclined sidewalls 340 interconnected to define a rectangular upper opening 342 by upper ends thereof and a rectangular lower opening 344 by lower ends thereof. Light reflecting material is preferred to be applied on inner surfaces of the inclined sidewalls 340 to increase light reflectance and brightness of the LEDs 24 of the LED modules 20. The lower opening 344 is smaller than the upper opening 342. Each of the guiding units 34 has a rectangular engaging flange 346 extending outwardly and horizontally from a circumference of the upper ends of the inclined sidewalls 340.

To assemble the light-guiding module 30, the guiding units 34 are respectively inserted into the through holes 322 of the mounting bracket 32 with the engaging flanges 346 of the guiding units 34 locked on the fixing board 320 of the mounting bracket 32 to thus hold the guiding units 34 in places.

During assembly, the LED modules 20 are placed on the first and second mounting plates 182, 16 of the heat sink 10 respectively. The fixing boards 320 of the mounting brackets 32 of the light-guiding modules 30 are then respectively mounted over the printed circuit boards 22 of the LED modules 20 with the LEDs 24 of the LED modules 20 respectively in alignment with and projecting into the lower openings 344 of the guiding units 34.

According to above-mentioned descriptions, the individual guiding units 34 are assembled through the mounting brackets 32 to form the light-guiding modules 30, suitable for the LED modules 20 of the disclosed embodiment and further for various types of brackets to suit different types of LED modules in different LED lamps.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light-guiding module adapted for being fixed on a light-emitting diode (LED) module to guide light emitted by a plurality of LEDs of the LED module, the light-guiding module comprising:

a mounting bracket with a top surface, the top surface defining a plurality of through holes therein; and a plurality of individual guiding units separably formed from the mounting bracket and respectively received in the through holes of the mounting bracket, each guiding unit comprising an engaging flange and a plurality of inclined sidewalls, the plurality of inclined sidewalls interconnected together to define a lower opening by a lower end thereof and an upper opening by an upper end thereof, the lower opening being smaller than that of the upper opening and disposed towards an underside of the mounting bracket and opposite to the upper opening, the engaging flange extending outwardly from a circumference of the upper opening thereof and resting on the top surface of the mounting bracket;

wherein each of the guiding units is adapted for receiving a corresponding LED therein for reflecting and guiding light generated by the corresponding LED in a predetermined manner.

2. The light-guiding module as claimed in claim 1, wherein the lower end of the guiding unit extends downwardly through the corresponding through hole of the mounting bracket adapted for receiving the corresponding LED in the lower opening thereof.

3. The light-guiding module as claimed in claim 1, wherein the mounting bracket comprises a fixing board in which the through holes are formed, two restricting flanges adapted to be located at two opposite lateral sides of the LED module and two supporting flanges extending downwardly from a bottom surface of the fixing board.

4. The light-guiding module as claimed in claim 3, wherein the supporting flanges parallel to the restricting flanges are perpendicular to the fixing board and adapted to be rested on a top surface of the LED module.

5. An LED lamp, comprising:

a heat sink comprising a base and a plurality of fins extending downwardly from a bottom surface of the base;

a plurality of LED modules mounted on a top of the heat sink and comprising a plurality of LEDs mounted thereon; and a plurality of light-guiding modules respectively fixed on the LED modules, each of the light-guiding modules comprising a mounting bracket defining a plurality of through holes therein, a plurality of guiding units separably formed from the mounting bracket and respectively received in the through holes of the mounting bracket;

wherein the guiding units are respectively in alignment with the LEDs of the LED modules and receive the LEDs in lower ends thereof to reflect and guide light generated by the LEDs in a predetermined manner, and wherein the heat sink comprises a plurality of mounting members each having a connecting plate extending upwardly from a top surface of the base and a mounting plate connected to a top end of the connecting plate, every two of the LED modules are mounted on the mounting plate.

6. The LED lamp as claimed in claim 5, wherein the connecting plates are parallel to each other, perpendicular to the base and decrease in height from a midline of the top surface of the base toward two lateral opposite sides of the base.

7. The LED lamp as claimed in claim 5, wherein the mounting plates are mounted on and angled from the top surface of the base, wherein the angles between the mounting plates and the top surface of the base gradually decrease from a midline of the top surface of the base toward the two opposite lateral sides of the base.

8. The LED lamp as claimed in claim 5, wherein the fins are perpendicular to the base and parallel to two opposite lateral sides of the base and the connecting plates.

9. The LED lamp as claimed in claim 5, wherein each of the guiding units comprises a plurality of inclined sidewalls interconnected together to define a lower opening by a lower end thereof and an upper opening by an upper end thereof, and wherein the lower opening is smaller than that of the upper opening and located at an underside of the mounting bracket and opposite to the upper opening.

10. The LED lamp as claimed in claim 9, wherein each of the guiding units has an engaging flange extending outwardly from a circumference of the upper opening thereof and resting on a top surface of the mounting bracket.

11. The LED lamp as claimed in claim 9, wherein the lower end of the guiding unit extends downwardly through a corresponding through hole of the mounting bracket and receives a corresponding LED in the lower opening thereof.

12. The LED lamp as claimed in claim 5, wherein the mounting bracket comprises a fixing board in which the through holes are formed, two restricting flanges located at two opposite lateral sides of a corresponding LED module and two supporting flanges extending downwardly from a bottom surface of the fixing board.

13. The LED lamp as claimed in claim 12, wherein the supporting flanges are parallel to the restricting flanges, perpendicular to the fixing board and rested on a top surface of the corresponding LED module, the restricting flanges are rested a top surface of a corresponding mounting plate.

14. The LED lamp as claimed in claim 5, wherein the heat sink is made of a heat conductive material.

15. The LED lamp as claimed in claim 14, wherein the conductive material is copper or aluminum.

16. The LED lamp as claimed in claim 9, wherein inner surfaces of the inclined sidewalls facing a corresponding LED are applied with a light reflecting material.

17. A light-guiding module adapted for being fixed on a light-emitting diode (LED) module to guide light emitted by a plurality of LEDs of the LED module, the light-guiding module comprising:

a mounting bracket defining a plurality of through holes therein; and a plurality of individual guiding units separably formed from the mounting bracket and respectively received in the through holes of the mounting bracket;

wherein each of the guiding units is adapted for receiving a corresponding LED therein for reflecting and guiding light generated by the corresponding LED in a predetermined manner; and wherein the mounting bracket comprises a fixing board in which the through holes are formed, two restricting flanges adapted to be located at two opposite lateral sides of the LED module and two supporting flanges extending downwardly from a bottom surface of the fixing board.

18. The light-guiding module as claimed in claim 17, wherein the supporting flanges parallel to the restricting flanges are perpendicular to the fixing board and adapted to be rested on a top surface of the LED module.

* * * * *